United States Patent [19]

Mims

[11] Patent Number: 4,949,494

[45] Date of Patent: Aug. 21, 1990

[54] REPEATING RUBBER BAND PISTOL

[76] Inventor: Donald B. Mims, 5665 Banks Rd., Fort Worth, Tex. 76140

[21] Appl. No.: 436,440

[22] Filed: Nov. 14, 1989

[51] Int. Cl.[5] ..... F41C 3/08

[52] U.S. Cl. ..... 42/54; 124/19; 124/35.1

[58] Field of Search ..... 42/54; 124/17, 18, 19, 124/31, 35 R

[56] References Cited

U.S. PATENT DOCUMENTS

| | | | |
|---|---|---|---|
| 369,914 | 9/1887 | Brown | 42/54 |
| 1,723,554 | 8/1929 | Malott | 124/19 |
| 1,724,708 | 8/1929 | Harris | 124/19 |
| 1,955,900 | 4/1934 | Bixler | 42/54 |
| 2,550,873 | 5/1951 | Siders | 124/19 |
| 2,689,558 | 9/1954 | Sealer et al. | 124/19 |
| 2,917,037 | 12/1959 | Henderson | 124/19 |
| 4,223,658 | 9/1980 | Sundstrom | 124/19 |

FOREIGN PATENT DOCUMENTS

| | | | |
|---|---|---|---|
| 73436 | 6/1917 | Austria | 42/54 |
| 439978 | 12/1935 | United Kingdom | 124/19 |

*Primary Examiner*—Charles T. Jordan
*Assistant Examiner*—Richard W. Wendtland
*Attorney, Agent, or Firm*—Charles D. Gunter, Jr.

[57] ABSTRACT

A repeating rubber band pistol is shown which includes a frame having a barrel and a handle. A handle recess houses a rotary magazine. A plurality of bands can be stretched between a barrel notch and engagement points on the rotary magazine. A trigger element is mounted within the frame recess and allows controlled movement of the rotary magazine to selectively release rubber bands in single fire fashion with successive trigger pulls.

3 Claims, 2 Drawing Sheets

REPEATING RUBBER BAND PISTOL

BACKGROUND OF THE INVENTION

1. Field of the Invention

The present invention relates to toy pistols and specifically to a rubber band pistol capable of shooting a plurality of rubber bands without reloading.

2. Description of the Prior Art

Rubber band pistols have been popular among children for many years. In the prior designs, a single rubber band is typically stretched between a band engaging region on the barrel and a cooperating region on the handle. A trigger element releases the rubber band from the handle engagement region, allowing the rubber band to be propelled forwardly from the barrel region.

The present invention has as its object to provide a rubber band pistol which allows a plurality of rubber bands to be shot in repeating fashion without reloading.

Another object of the invention is to provide a repeating rubber band pistol of simple design which is economical to manufacture. Another object of the invention is to provide a rubber band piston which is reliable in operation.

Additional objects, features and advantages will be apparent in the written description which follows.

SUMMARY OF THE INVENTION

The repeating rubber band pistol of the invention includes a pistol frame having a forward, band engaging region and an upwardly facing recess. A rotary magazine is located in the upwardly facing recess and has a plurality of radially extending elongated arms for engaging rubber bands which are stretched between the forward, band engaging region and selected ones of the radially extending arms in readiness for shooting. A trigger element is pivotally mounted in the frame recess. The trigger element includes stop means receivable between selected ones of the radially extending arms to prevent rotation of the magazine within the frame recess The trigger element is pivotable between a ready position in which the stop means prevents rotation of the magazine and a firing position in which the stop means allows limited rotation of the magazine to release a rubber band for firing. Biasing means, located within the frame recess, normally urge the trigger element toward the ready position.

DETAILED DESCRIPTION OF THE INVENTION

Figure 1:
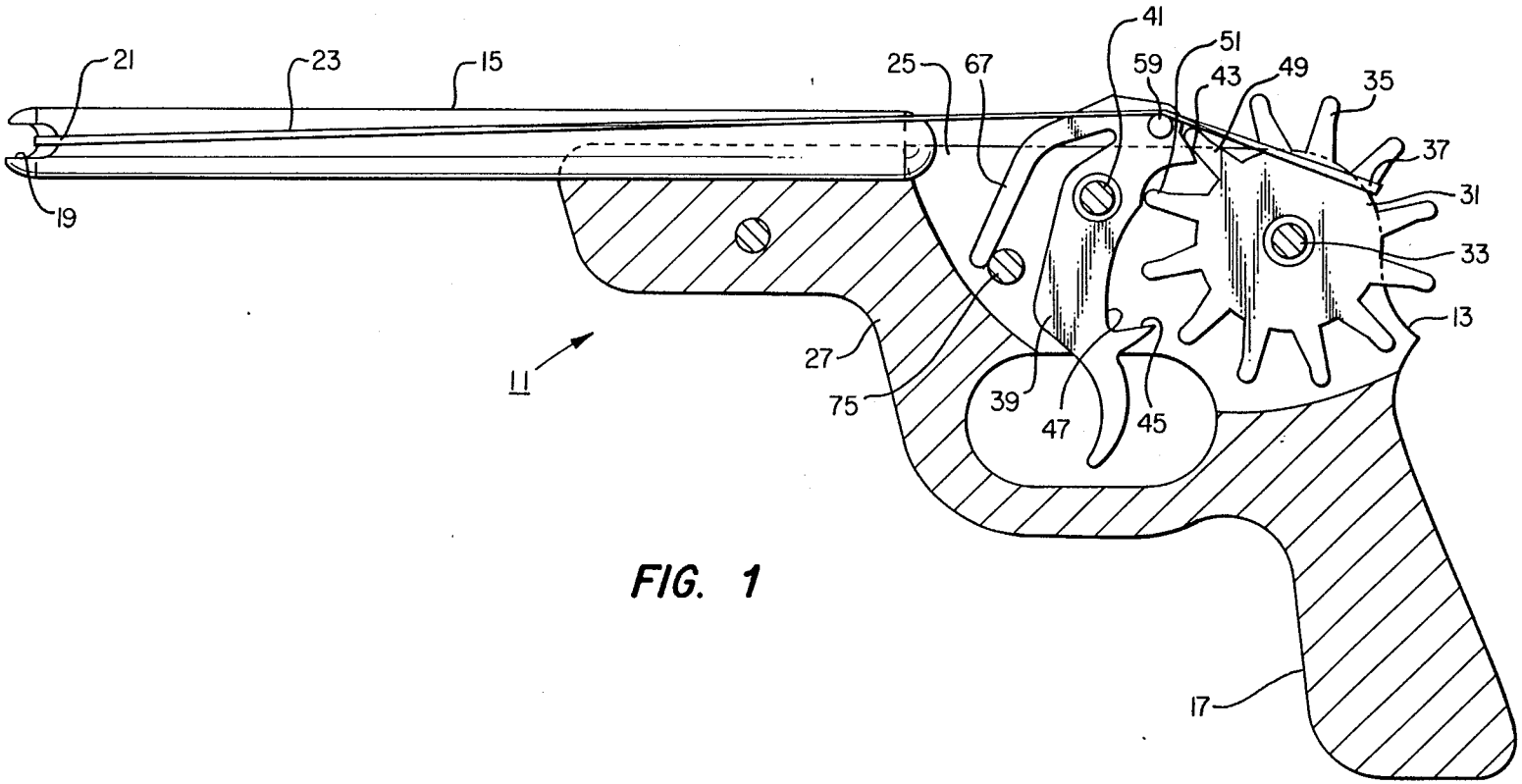
FIG. 1 is a side view of the pistol of the invention with portions of the frame broken away to better illustrate the internal components.

FIG. 1 shows a repeating rubber band pistol of the invention designated generally as 11. The pistol 11 includes a frame 13 having a barrel region 15 attached to a handle region 17. The barrel region 15 has a band receiving region, such as forward barrel notch 19, for engaging one end 21 of a rubber band 23. The handle region 17 also includes an upwardly facing recess 25 defined between opposing sidewalls 27, 29.

A rotary magazine 31 is mounted on an axle 33 extending transverse to the opposing sidewalls 27, 29 of the upwardly facing recess 25. The rotary magazine 31 is a spindle-like member with the axle 33 comprising a central rotational axis. A plurality of radially extending, elongated arms 35 are disposed circumferentially about the central rotational axis 33 on the magazine 31 for engaging the opposite ends 37 of a plurality of rubber bands (one of which is shown in FIG. 1) which are stretched between the forward band engaging region 19 and selected ones of the radially extending arms 35 in readiness for shooting.

Figure 2:
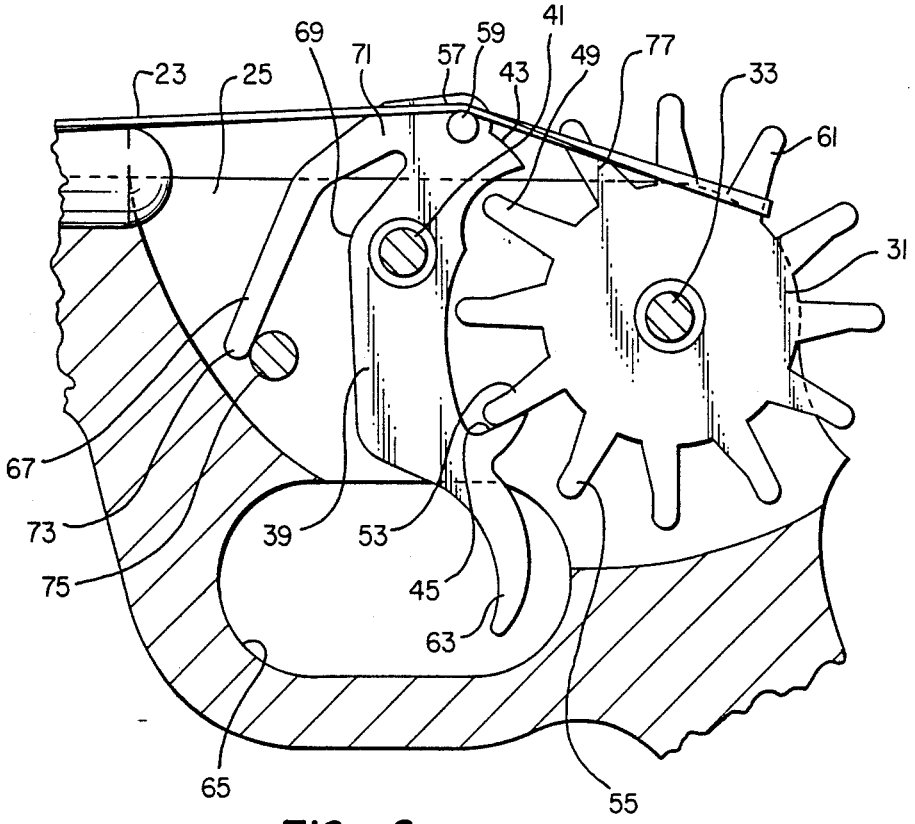
FIG. 2 is an isolated view of the rotary magazine and trigger element of the pistol of FIG. 1 showing the trigger in the firing position.
Figure 3:
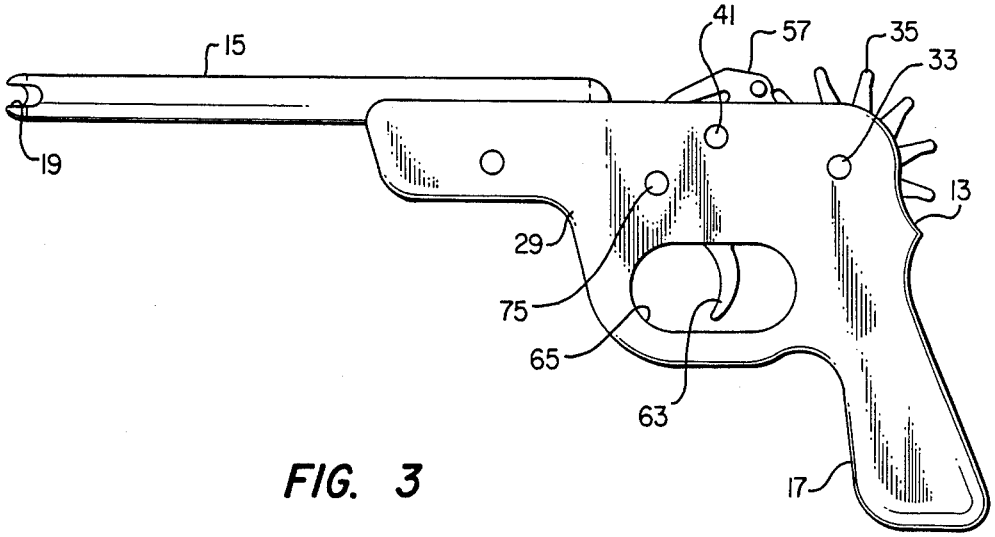
FIG. 3 is a side, perspective view of the pistol of FIG. 1.

A trigger element 39 is pivotally mounted in the frame recess 25 on a transverse pin 41 which is located within the handle recess between the opposing sidewalls 27, 29. The trigger element 39 is pivotally mounted for movement between a ready position (FIG. 1) and a firing position (FIG. 2). The trigger element includes first and second stop means, such as cam regions 43, 45 which are formed on an interior surface of the trigger element 47. As shown in FIG. 1, the spaced cam regions 43, 45 form an arcuate gap on the interior surface 47, the gap being of a predetermined width, whereby only the first cam region 43 is received between selected ones 49, 51 of the radially extending arms 35 to prevent rotation of the magazine within the frame recess in the ready position. As shown in FIG. 2, only the second of the cam regions 45 is received between selected ones 53, 55 of the radially extending arms in the firing position.

The trigger element 39 includes an exposed region 57 (FIG. 2) which extends upwardly above the handle recess 25. The exposed region 57 includes a cross-piece 59 slightly larger than the width of the handle recess 25 for supporting a portion of the length of a rubber band 23 stretched between the barrel notch 19 and the radially extending arm 61 on the rotary magazine 31.

The trigger element 39 also includes a finger engagement region 63, the second cam region 45 and the finger engagement region 63 together forming a boot-shaped extension which protrudes at least partly from the handle recess 25 into a finger guard opening 65.

The trigger element 39 also includes a downwardly extending flexible leg 67 which angles away from the trigger element exterior surface 69 at an acute angle. The flexible leg 67 is preferably integrally formed with the trigger element 39 from a flexible plastic material and has an a proximate end 71 and a distal end 73. The distal end 73 is contactable with an additional transverse pin 75 located within the handle recess 25 which serves as a biasing point for the flexible leg for normally urging the trigger element 39 to the ready position shown in FIG. 1.

In operation, a first rubber band (23 in FIG. 1) has one end stretched between the barrel notch 19 and has an opposite end 37 engaged by a selected one of the radially extending arms 35 of the rotary magazine 31. The rotary magazine 31 can be rotated in a clockwise direction by pressure of the user's fingers on the radially extending arms to further stretch the rubber band 23, if desired. Additional rubber bands can then be stretched between the barrel notch 19 and other of the selected radially extending arms 35. Only one rubber band is illustrated in FIG. 1 for simplicity.

In the ready position shown in FIG. 1, the first cam surface 43 engages the interior surface of the radially extending arm 49 preventing rotation of the magazine 31. The flexible leg 67 contacts the pin 75, urging the trigger element to the ready position.

As the trigger element is pulled (FIG. 2) the first cam region 43 moves from beneath the selected arm 49, thereby allowing the rotary magazine 31 to rotate in a counterclockwise direction until the radial arm 53 contracts the second cam region 45. The spacing of the first and second cam regions 43, 45 allows only a single radially extending arm 49 to move past the first cam region 43 as the trigger is pulled. As the trigger pressure is released, the resilient nature of the flexible leg 67 biases the trigger element about the pin 41 in a clockwise direction to engage the first cam region 43 with the next successive radially extending arm 77 of the rotary magazine 31. Successive trigger pulls release successive bands 23 in single fire order.

An invention has been provided with several advantages. The trigger and rotary magazine design allows a plurality of rubber bands to be shot in repeating fashion without reloading. The mechanism is simple in design and economical to manufacture. The mechanism is durable and reliable in operation.

While the invention has been shown in only one of its forms, it si not thus limited but is susceptible to various changes and modifications without departing from the spirit thereof.

I claim:

1. A repeating rubber band pistol, comprising:

a pistol frame having a barrel region attached to a handle region, the barrel region having a forward barrel notch for engaging one end of a rubber band, the handle region having an upwardly facing recess defined between opposing sidewalls;

a rotary magazine mounted on an axle extending transverse to the opposing sidewalls of the upwardly facing recess, the rotary magazine having a central rotational axis and having a plurality of radially extending elongated arms disposed circumferentially about the central rotational axis on the magazine for engaging the opposite ends of a plurality of rubber bands which are stretched between the forward, band engaging region and selected ones of the radially extending arms in readiness for shooting;

a trigger element pivotally mounted in the frame recess for movement between a ready position and a firing position, the trigger element including first and second spaced cam regions formed on an interior surface of the trigger element, the spaced cam regions forming an arcuate gap on the interior surface of the trigger element, the gap being of a predetermined width, whereby only the first of the cam regions is received between selected ones of the radially extending arms to prevent rotation of the magazine within the frame recess in the ready position and only the second of the cam regions is received between selected ones of the radially extending arms in the firing position;

a flexible leg having a proximate end integrally formed with the trigger element and having a distal end contactable with the frame interior for normally urging the trigger element toward the ready position; and wherein the trigger element includes an exposed region which extends upwardly above the handle recess, the exposed region of the trigger element including a cross piece for supporting a portion of the length of a rubber band stretched between the barrel notch and the selected radially extending arm on the rotary magazine.

2. The repeating rubber band pistol of claim 1, wherein the trigger element includes a finger engagement region, the second cam region and the finger engagement region together forming a boot-shaped extension which protrudes at least partly from the handle recess.

3. The repeating rubber band pistol of claim 2, wherein the trigger element is mounted within the handle recess on a transverse pin, and wherein an additional transverse pin located within the handle recess serves as a biasing point for the flexible leg for normally urging the trigger element to the ready position.

* * * * *